US010100571B2

(12) United States Patent
Deman

(10) Patent No.: US 10,100,571 B2
(45) Date of Patent: Oct. 16, 2018

(54) CONCEALED HINGE FOR A PIVOTING WINDOW OR PIVOTING DOOR AND WINDOW EQUIPPED THEREWITH

(71) Applicant: Remi Emiel Van Parys, Waregem (BE)

(72) Inventor: Joseph Jules Deman, St. Eloois Vijve (BE)

(73) Assignee: VAN PARYS, REMI EMIEL, Waregem (BE)

( * ) Notice: Subject to any disclaimer, the term of this patent is extended or adjusted under 35 U.S.C. 154(b) by 328 days.

(21) Appl. No.: 14/976,386

(22) Filed: Dec. 21, 2015

(65) Prior Publication Data

US 2016/0186473 A1 Jun. 30, 2016

(30) Foreign Application Priority Data

Dec. 29, 2014 (BE) ..... 2014/0854

(51) Int. Cl.

| | |
|---|---|
| ***E05D 15/28*** | (2006.01) |
| ***E06B 3/34*** | (2006.01) |
| ***E05D 3/18*** | (2006.01) |
| ***E05D 7/084*** | (2006.01) |
| ***E05D 11/06*** | (2006.01) |

(Continued)

(52) U.S. Cl.

CPC ..... *E06B 3/341* (2013.01); *E05D 3/186* (2013.01); *E05D 7/084* (2013.01); *E05D 11/06* (2013.01); *E05F 1/1261* (2013.01); *E05D 11/1007* (2013.01); *E06B 2003/343* (2013.01)

(58) Field of Classification Search

CPC ..... E05D 3/186; E05D 7/084; E05D 11/06; E05D 11/00; E05D 11/1064; E05D 15/52; E05D 15/5217; E05D 15/5205; E05C 9/066; E05Y 2900/148; Y10T 16/558; E06B 3/38

USPC ..... 52/204.51, 204.55, 202; 49/246, 192, 49/193, 149, 501, 498.1, 381, 295, 339, 49/504; 16/298, 306, 364; 292/33, 138, 292/157, DIG. 20, DIG. 33

See application file for complete search history.

(56) References Cited

U.S. PATENT DOCUMENTS 2,374,618 A * 4/1945 Perreton ..... E05D 15/46 49/153
3,727,142 A * 4/1973 De Sipio ..... G01R 29/0273 327/20

(Continued)

FOREIGN PATENT DOCUMENTS

CH 493 729 A 7/1970

*Primary Examiner* — Chi Q Nguyen
(74) *Attorney, Agent, or Firm* — Sughrue Mion, PLLC

(57) ABSTRACT

A hinge for a pivoting window or door with a frame and a leaf that can tilt with respect to the frame, whereby the hinge includes a frame part fastened to the frame and a leaf part fastened to the leaf, with a scissor mechanism between the frame part and the leaf part on which the leaf part is hingeably affixed around an axis of rotation, whereby the scissor mechanism comes into operation in a first phase of the tilting movement of the leaf, so that the axis of rotation moves in a direction essentially transverse to the plane of the frame into a locking position whereby the axis of rotation is at a distance from the frame such that the axis of rotation is a fixed axis around which the leaf can tilt further in a second phase of the tilting movement of the leaf.

15 Claims, 12 Drawing Sheets

(51) Int. Cl.
*E05F 1/12* (2006.01)
*E05D 11/10* (2006.01)

(56) References Cited

U.S. PATENT DOCUMENTS 4,802,307 A * 2/1989 Schmidt ..... E05D 15/1015
49/130
5,111,615 A * 5/1992 Kuhnt ..... E05F 11/16
49/13
5,533,778 A * 7/1996 Sheridan ..... F41H 5/226
296/152
5,675,948 A * 10/1997 Boesch ..... E04C 1/42
49/498.1
6,135,511 A * 10/2000 Smith ..... E05C 9/063
292/139
6,431,620 B2 * 8/2002 Tremblay ..... E05C 9/185
292/263
6,644,884 B2 * 11/2003 Gledhill ..... E05C 17/045
403/315
6,749,797 B2 * 6/2004 Kownacki et al. .....
B29C 45/1704
264/328.1
7,100,327 B2 * 9/2006 Rangabasyam ..... E05C 9/02
292/161
8,161,683 B2 * 4/2012 Van Parys ..... E05D 15/52
292/141
8,572,895 B2 * 11/2013 Kollar ..... G02B 23/16
348/148

* cited by examiner

CONCEALED HINGE FOR A PIVOTING WINDOW OR PIVOTING DOOR AND WINDOW EQUIPPED THEREWITH

CROSS REFERENCE TO RELATED APPLICATIONS

This application is claiming priority based on Belgium Patent Application No. 2014/0854, filed Dec. 29, 2014, the contents of all of which are incorporated herein by reference in their entirety.

BACKGROUND OF THE INVENTION

Field of the Invention

The present invention concerns a concealed hinge for a pivoting window or pivoting door and a window equipped therewith.

Background

More specifically, the invention is intended for horizontally pivoting windows, i.e. 'tilting windows', and for vertically pivoting windows, i.e. 'swing windows'.

A concealed hinge means a hinge for hingeably or pivotably affixing a leaf to a fixed frame, whereby the hinge is built into a space provided for this purpose between the leaf and the fixed frame, so that the hinge cannot be seen in a closed position of the leaf.

Existing concealed hinges consist of two hinge leaves that are each composed of two parts, made from a first part and a second part. The first part is immovably fastened to a fixed frame, or the leaf respectively, whereby this first part is hingeably fastened to the second part concerned. In turn, both parts are hingeably fastened together by means of an actual hinge pin.

In such known hinges the aforementioned hinge pin moves, and in particular the centre of gravity of the leaf, with respect to the fixed frame and with respect to the leaf during the opening or closing of the leaf, at least partially in a vertical upward movement. This is necessary to move the leaf out of the plane of the frame when opening the window, so that the leaf and fixed frame profiles do not collide with one another.

A disadvantage of such known hinges is that, due to their structure, they can only be used with relatively light leaves, as otherwise the operating forces would be too great.

However, due to the stricter requirements regarding insulation, the profiles of the frame and the leaf are becoming ever deeper to be able to affix more insulation, and the glass is becoming increasingly thick.

This means that the leaf is relatively heavy, and moreover the centre of gravity of the leaf slides further away from the hinge pin.

As a result the known hinges cannot be used, because during the opening of the window large operating forces will be required because the centre of gravity of the leaf moves in the upward direction during the opening and closing of the leaf.

Moreover, it is more difficult to obtain a balance with a partially open leaf, so that in the partially open position the leaf falls shut by itself.

The stricter requirements with regard to insulation and the accompanying seals and thermal breaks that must be affixed in the profiles ensure that the space for building in and operating the hinges between the fixed frame and the leaf, in particular between the profiles of the two, is becoming ever smaller.

As a result it is not always possible to use the sizeable known concealed hinges.

Due to the aforementioned problems and disadvantages with the known concealed hinges, gas springs are often used.

However, this is an expensive alternative and moreover it is not possible to tilt or pivot the window over 180°. In addition, such gas springs require custom work as gas springs are not easy to regulate or adjust according to the type of leaf, profiles or glass for which the gas spring is used. This results in a logistical disadvantage.

SUMMARY OF THE INVENTION

The purpose of the present invention is to provide a solution to at least one of the aforementioned and other disadvantages.

The subject of the present invention is a hinge for a pivoting window or a pivoting door with a frame and a leaf that can tilt with respect to the frame, characterised in that the hinge comprises a frame part that is intended to be fastened to the frame and a leaf part that is intended to be fastened to the leaf, with a scissor mechanism between the frame part and the leaf part on which the leaf part is hingeably affixed around an axis of rotation, whereby the scissor mechanism is such that in the first phase of the tilting movement of the leaf the scissor mechanism comes into operation, so that the axis of rotation moves in a direction essentially transverse to the plane of the frame into a locking position whereby the axis of rotation is at a distance from the frame such that the axis of rotation is a fixed axis around which the leaf can tilt further in a second phase of the tilting movement of the leaf.

An advantage of such a hinge is that due to the displacement of the axis of rotation and subject to a judicious selection of the construction of the scissor mechanism, no collisions can occur between the profiles of the frame and the leaf during the opening and closing of the leaf.

This will help enable the leaf to be opened over 180°.

During the first phase the leaf tilts around a non-fixed hinge pin to simultaneously bring the axis of rotation to a displaced, fixed location.

After this, this axis of rotation is a fixed axis of rotation around which the leaf can tilt during the second phase.

This has the advantage that in the second phase the centre of gravity of the leaf is closer to the aforementioned fixed axis of rotation than to the hinge pin during the first phase.

As a result, the operating forces to further open the window decrease in the second phase.

Preferably the form and dimensions of the scissor mechanism are such that the displacement of the axis of rotation during the aforementioned first phase is horizontal or as good as horizontal.

This has the advantage that during the first phase of the tilting movement the weight of the leaf has to be raised less, so that the operating forces can be limited compared to the known concealed hinges.

According to a preferred characteristic of the invention the locking position of the scissor mechanism corresponds to a position of the leaf whereby the leaf includes an angle of between 75 and 115 degrees with the plane of the frame.

This has the advantage that in the locking position, which thus corresponds to the transition from the first to the second phase of the tilting movement, the leaf as good as balances on the axis of rotation in equilibrium, so that little force is required to tilt the leaf further.

The invention also concerns a window with a frame and a leaf that can tilt with respect to the frame, whereby the frame is provided with at least two hinges according to the invention such that both hinges form a horizontal or vertical axis of rotation around which the leaf can tilt horizontally or vertically.

BRIEF DESCRIPTION OF THE DRAWINGS

With the intention of better showing the characteristics of the invention, a few preferred embodiments of a concealed hinge according to the invention for a pivoting window or pivoting door and window equipped therewith, are described hereinafter by way of an example, without any limiting nature, with reference to the accompanying drawings, wherein:

FIG. 13 schematically shows a perspective view of an alternative embodiment of FIG. 11;

DETAILED DESCRIPTION OF THE PREFERRED EMBODIMENT OF THE INVENTION

Figure 1:
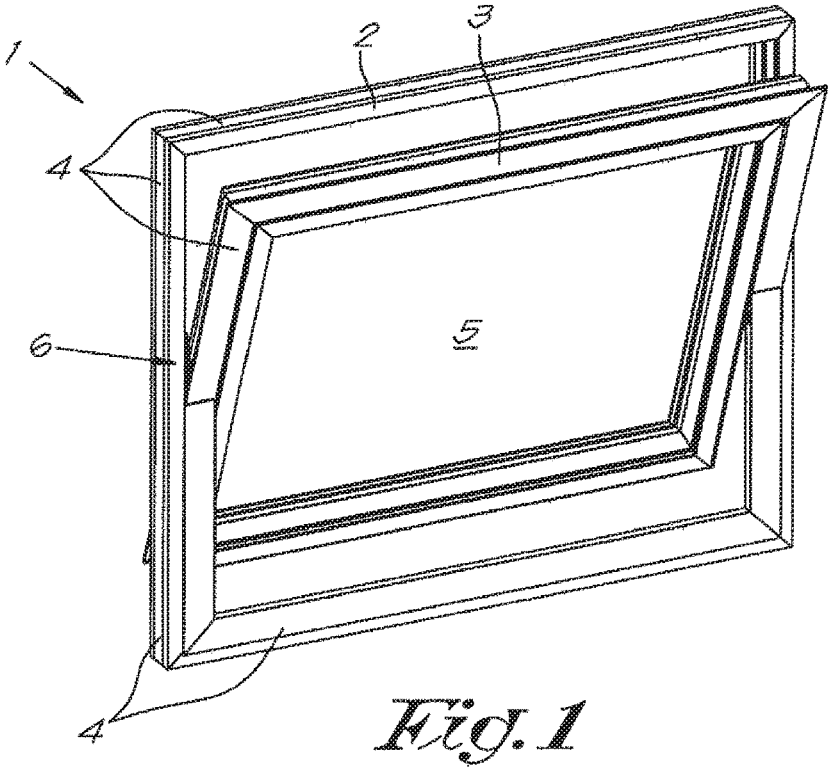
FIG. 1 schematically shows a perspective view of a window according to invention.

The window 1 shown in FIG. 1 comprises a fixed frame 2 that is intended to be built into a wall and a leaf 3 that is tiltably of pivotably affixed in the frame 2.

The frame 2 and leaf 3 are made of profiles 4 and a sheet of glass 5 is affixed in the leaf 3.

In this case the leaf 3 can pivot horizontally with respect to the frame 2.

To this end a hinge 6 is built into the two opposite vertical profiles 4 of the frame 2 and the leaf 3, whereby the hinges 6 are located in the centre of these profiles 4.

The hinges 6 form as it were an axis around which the leaf 3 can tilt, whereby the bottom part of the leaf 3 turns outwards and the top part inwards.

As can be seen in FIG. 1, the hinges 6 are concealed hinges 6. This means that the hinges 6 are not visible when the window 1 is closed.

In this way the hinges 6 are protected against outside influences such as weather conditions, vandalism, etc.

Figure 2:
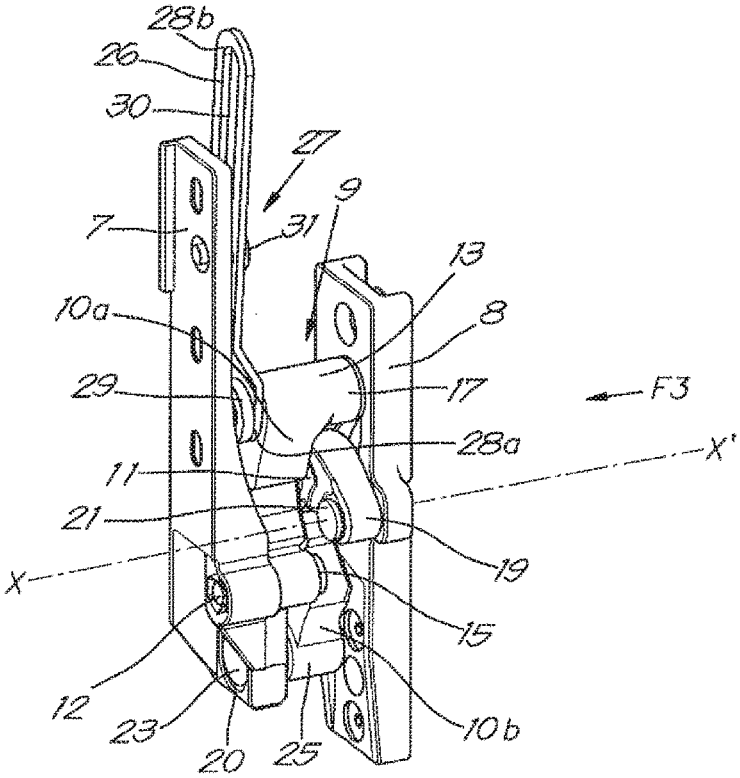
FIG. 2 schematically shows a perspective view of a concealed hinge according to the invention.
Figure 3:
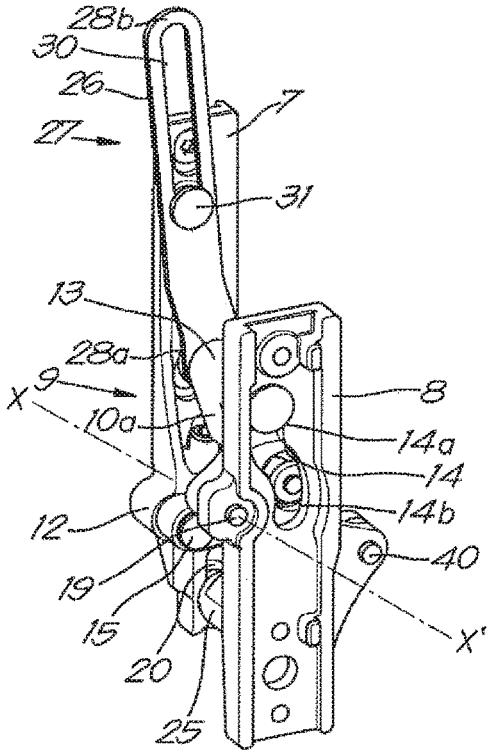
FIG. 3 schematically shows a perspective view of the view according to arrow F3 in FIG. 2.
Figure 4:
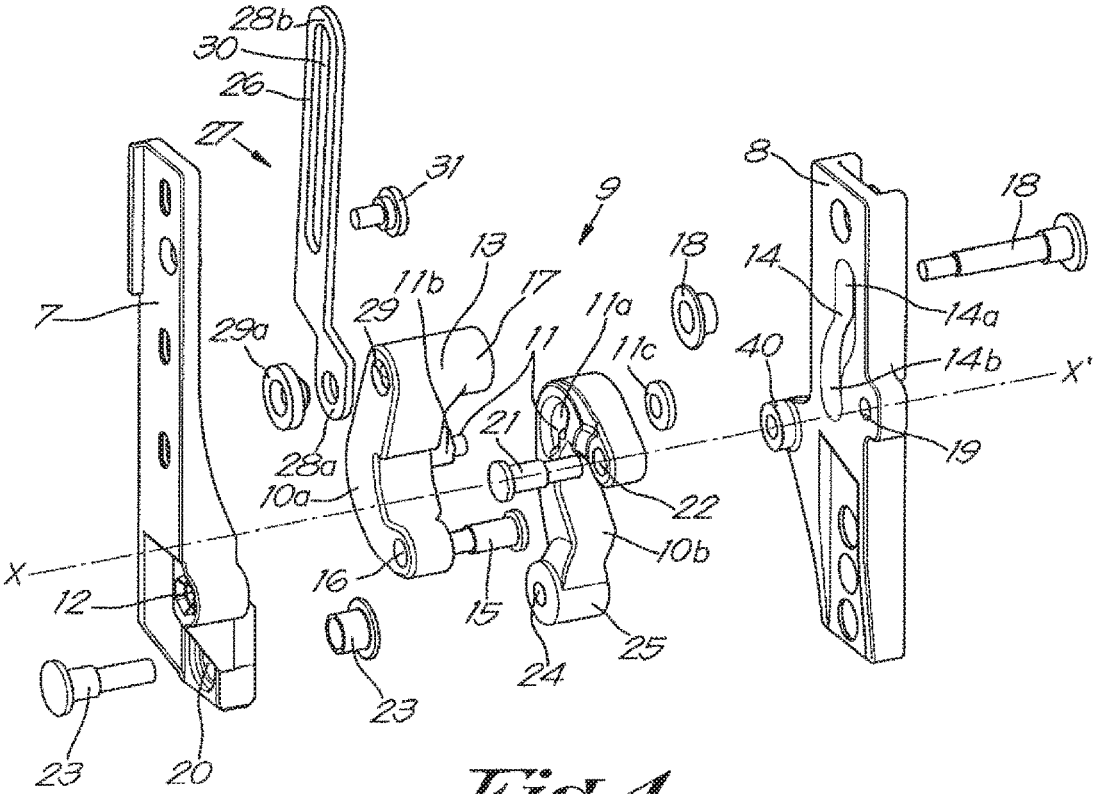
FIG. 4 schematically shows an exploded view in perspective of the concealed hinge of FIGS. 2 and 3.

A concealed hinge 6, as used in the window of FIG. 1, is shown in more detail in FIGS. 2 to 4.

The hinge 6 essentially comprises three components:

- a frame part 7 that is intended to be fastened to the fixed frame, in the example shown in the form of a plate part that can be fastened against a profile 4 of the frame 2;
- a leaf part 8 that is intended to be fastened to the leaf 3, in the example shown in the form of a plate part that can be fastened against a profile 4 of the leaf 3;
- a scissor mechanism 9 that is affixed between the frame part 7 and the leaf part 8 and on which the leaf part 8 is hingeably affixed around an axis of rotation X-X'.

The frame part 7 and the leaf part 8 are affixed to the frame 2 and the leaf 3 such that the hinge 6 cannot be seen when the leaf 3 is in the closed position.

The aforementioned scissor mechanism 9 comprises two arms 10*a*, 10*b* that are connected together by a pin-groove 11 connection.

A first arm 10*a* has a fixed hinge point 12 on the frame part 7 and an end 13 and that is movably held in a groove 14 of the leaf part 8.

The fixed hinge point 12 on the frame part is formed by a pawl 15, pin, rivet or similar that extends through a cavity 16 provided for this purpose in the first arm 10*a* and is fastened in the frame part 7.

The end 13 of the first arm that is movably held in the groove 14 of the leaf part 8 is provided with a trunnion 17 or similar that is movably held in the aforementioned groove 14, in this case using a pin 18, pawl, rivet or similar.

This groove 14 comprises a straight piece 14*a* with a connecting arched piece 14*b*.

The second arm 10*b* has a fixed hinge point 19 on the leaf part 8 that is coaxial with the axis of rotation X-X' and is movably held in a slip hole 20 in the frame part 7.

The fixed hinge point 19 on the leaf part is realised by a pawl 21, pin, rivet or similar that extends through a cavity 22 provided to this end in the second arm 10*b* and is fastened in the leaf part 8.

The second arm 10*b* is held in the slip hole 20 by means of a pawl 23, pin, rivet or similar that extends through a cavity 24 provided for this purpose on the end 25 of the second arm 10*b* and is movably held in the slip hole 20.

In this case this slip hole 20 is a straight slip hole 20.

The groove 11*a* of the aforementioned pin-groove connection 11 that forms a connection between the first arm 10*a* and the second arm 10*b* has an arch shape, whereby the pin 11*b* has a corresponding curved form that is movable in the groove 11*a*.

In this case the groove 11*a* is affixed in the second arm 10*b* and the first arm 10*a* is provided with a corresponding pin 11. This can of course also be the other way around.

The pin 11*b* is fastened in the groove 11*a* by means of ring 11*c* that can be affixed over the end of the pin 11*b*.

The aforementioned scissor mechanism 9 is designed such that, more specifically the locations of all aforementioned pawls 15, 21, 23, pins 18, cavities 16, 22, slip hole 20, pin-groove connection 11, etc, are chosen such that, in a closed position of the leaf 3, the scissor mechanism 9 is entirely or as good as entirely between the frame part 7 and the leaf part 8.

Furthermore, the hinge 6 is also provided with a supporting arm 26, which is hingeably connected to the scissor mechanism 9 and also to the frame part 7 via a pin-groove 27 connection.

In the example shown, one end 28*a* of the supporting arm 26 is connected to the first arm 10*a* at the location of a fixed hinge point 29 using a trunnion or screw 29*a*, whereby this hinge point 29 is coaxial with the trunnion 17 of the first arm 10*a*.

The other end 28*b* is provided with a long straight groove 30 in which a pin 31 or pawl is movably held that is fastened to the frame part 7.

The operation of the hinge 6 is as follows.

When the leaf is in a closed position and the hinge 6 will be in the position as shown in FIGS. 2 and 3.

Figure 5:
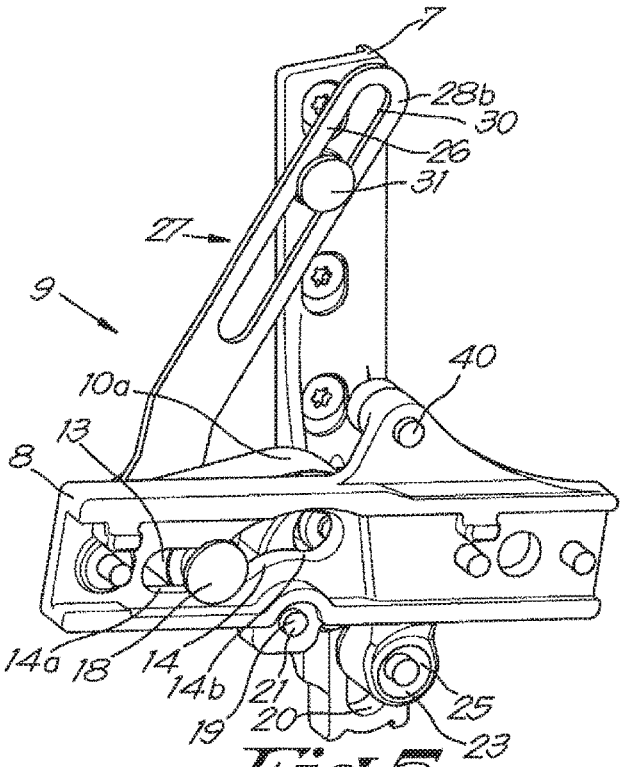
FIG. 5 schematically shows a perspective view of the concealed hinge of FIG. 3, but in a different position.
Figure 6:
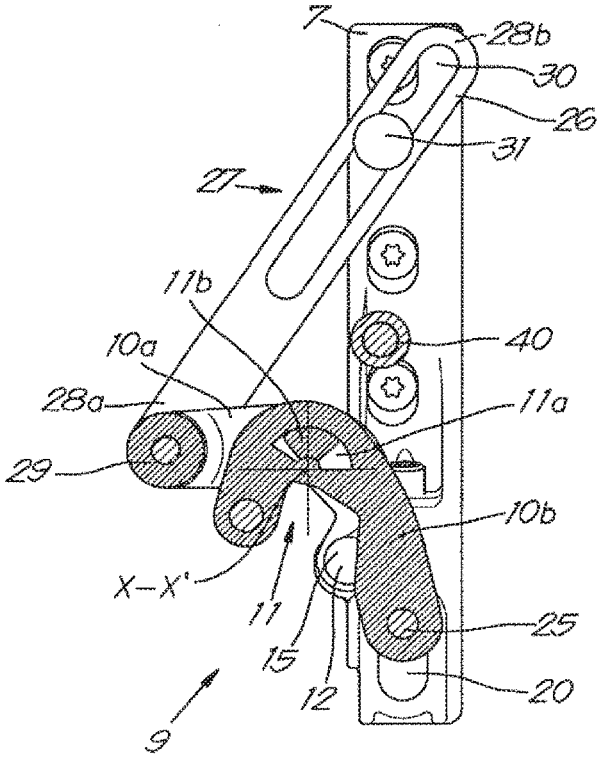
FIG. 6 schematically shows the concealed hinge of FIG. 5, whereby the leaf part is omitted.

When the leaf 3 is opened, the scissor mechanism 9 will operate. FIGS. 5 and 6 show the hinge 6 in a partially open position.

In this case the leaf part 8 is tilted with respect to the frame part 7 due to the action of the scissor mechanism.

Hereby the trunnion 17 of the first arm 10*a* is moved in the straight section 14*a* of the groove 14 in the leaf part 8 and the pawl 23 of the second arm 11*b* is moved in the slip hole 20 of the frame part 7.

The pin 11*b* of the pin-groove connection 11 between the two arms 10*a*, 10*b* is moved in the groove 11*a*, as the arms 10*a*, 10*b* are moved with respect one another.

The pin 31 of the pin-groove connection 27 of the supporting arm 26 is also moved in the groove 30 concerned.

During this first phase of the tilting movement of the leaf 3, the axis of rotation X-X' moves in a direction essentially transverse to the plane of the frame 2. Thanks to the design of the scissor mechanism 9, this movement proceeds in as good as a horizontal direction, i.e. the movement proceeds with the least possible upward movement.

By tilting the leaf 3 somewhat further, the scissor mechanism 9 will come to the locking position, whereby the axis of rotation X-X' is in the fixed position.

In the locking position the pin 11*b* is at the end of the groove 11*a*. The pin 31 of the supporting arm 26 is at the end of the groove 30. The trunnion 17 of the first arm 11*a* is at the location of the transition from the straight section 14*a* to the arched section 14*b* of the groove 14 in the leaf part 8.

Figure 7:
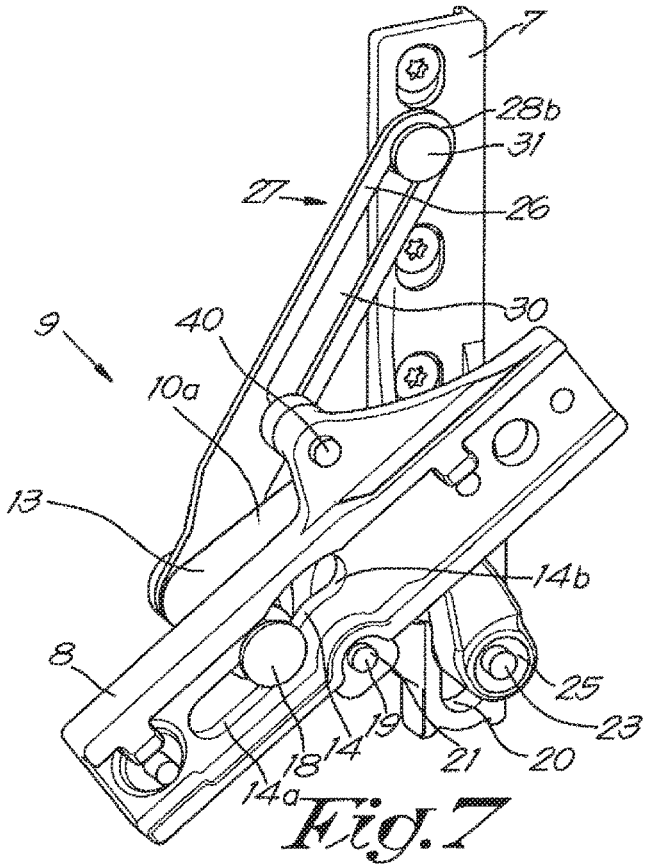
FIG. 7 shows a different position of the concealed hinge of FIG. 5.
Figure 8:
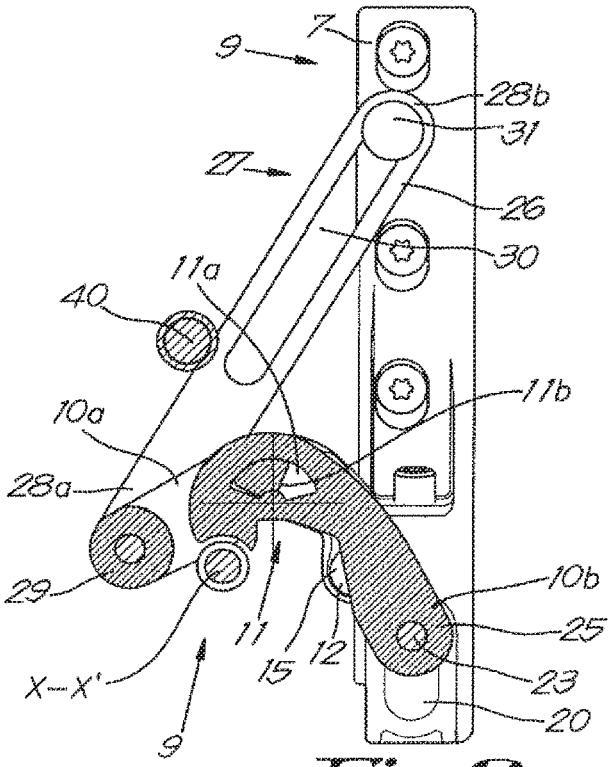
FIG. 8 schematically shows the concealed hinge of FIG. 7, whereby the leaf part is omitted.

FIGS. 7 and 8 show the situation whereby the scissor mechanism 9 is in the locking position. This locking position can be seen very clearly in FIG. 8.

Preferably the locking position corresponds to a position of the leaf 3 whereby the leaf 3 includes an angle between 75° and 115° with the plane of the frame 2.

As of the moment that the scissor mechanism 9 is in the locking position, the axis of rotation X-X' is a fixed axis that will no longer be displaced.

At the same time the pin 31 of the supporting arm 26 comes to the end of the groove 30 so that as of this moment the supporting arm 26 will transmit part of the weight of the leaf 3 to the frame part 7.

At this moment the second phase of the tilting movement is started, whereby the leaf 3 will tilt further around the, now fixed, axis of rotation X-X'. During this entire second phase the supporting arm 26 will transmit the weight of the leaf 3 to the frame part 7.

As can be seen in FIG. 7, whereby the leaf 3 has already started the second phase, the trunnion 17 of the first arm 10*a* will move on into the arched section 14*b* of the groove 14 in the leaf part 8, to enable the tilting of the leaf 3 around the axis of rotation X-X'.

Note that in this second phase of the tilting movement, only the leaf part 8 will move with respect to the frame part 7. The arms 10*a*, 10*b* do not move with respect to the frame part 7.

The leaf part 8 can turn further until it is finally tilted by 180° so that the leaf 3 is also fully tilted by 180°. This situation is shown in FIG. 9.

Figure 9:
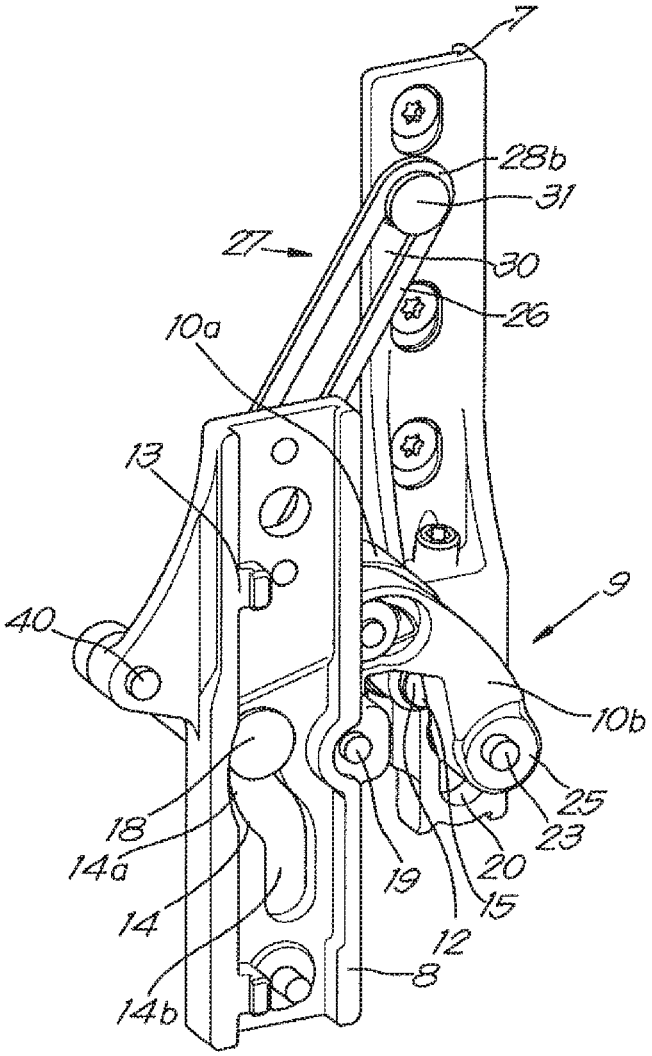
FIG. 9 shows a different position of the concealed hinge of FIG. 7.

Note that in the situation in FIG. 9 too, the scissor mechanism 9 is still in the position of FIG. 8.

Figure 10:
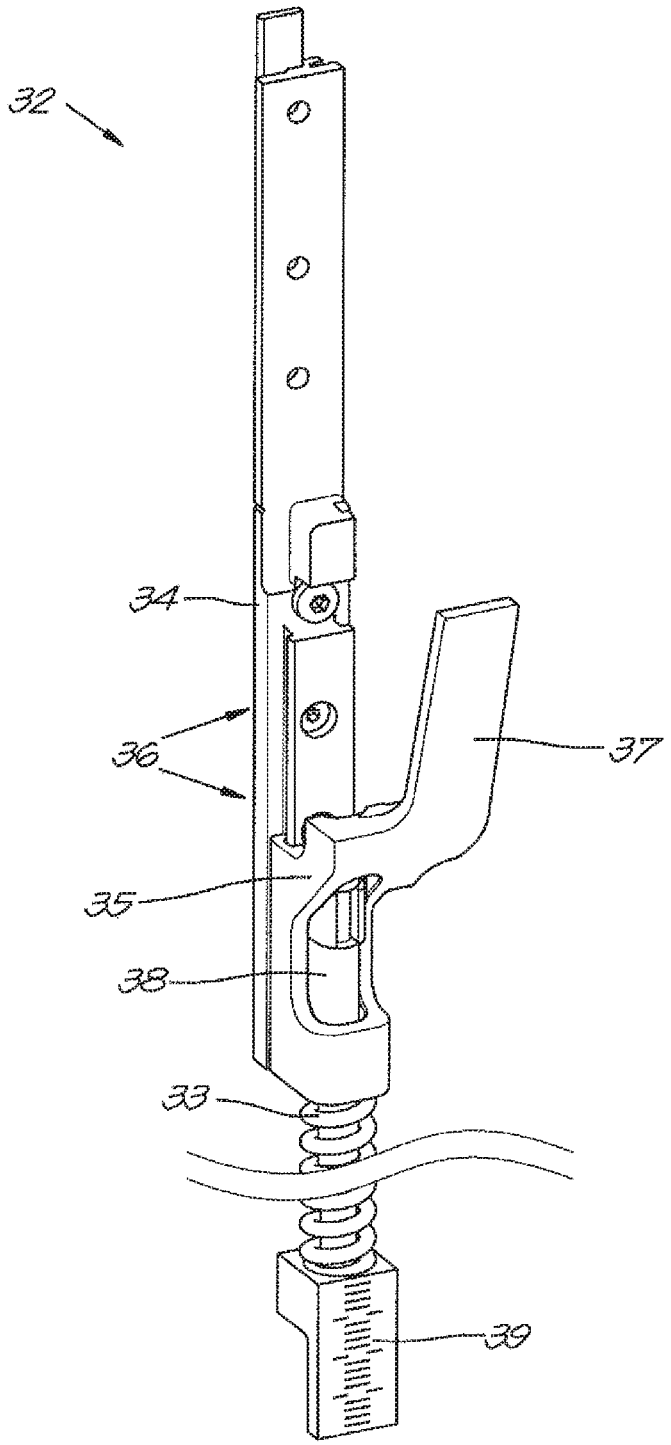
FIG. 10 schematically shows a perspective view of a spring system according to the invention.

In a preferred embodiment the hinge 6 is provided with a spring system 32 with a spring 33, as shown in FIG. 10.

This spring system 32 will offset the moment exerted by the weight of the leaf 3, at least in a part of the first phase of the tilting movement.

In the example of FIG. 10, a spring mechanism 32 can comprise a guide 34 on which a connecting piece 35 is movably affixed.

In this example, but not necessarily, this is realised by means of a tongue-groove connection 36.

In this case, the connecting piece 35 comprises a protruding protrusion 37 in the form of a tongue 37.

The spring 33 is held around a rod 38. The rod 38 is affixed to the guide 34 at one end so that the spring 33 can act on the aforementioned connecting piece 35.

Alternatively, it is also possible that the spring 33 is held in a tube, whereby this tube is affixed to the guide 34.

In this example, but not necessarily, the rod 38 is provided with an adjustment screw 39. This adjustment screw 39 is affixed to the other end of the rod 38 and by turning the adjustment screw 39 the force of the spring 33 and thus the spring tension can be changed, and the force that the spring 33 exerts on the connecting piece 35 can be adjusted.

The spring system 32 with the guide 34 can be affixed to the leaf 3 at the location of the leaf part 8.

Figure 11:
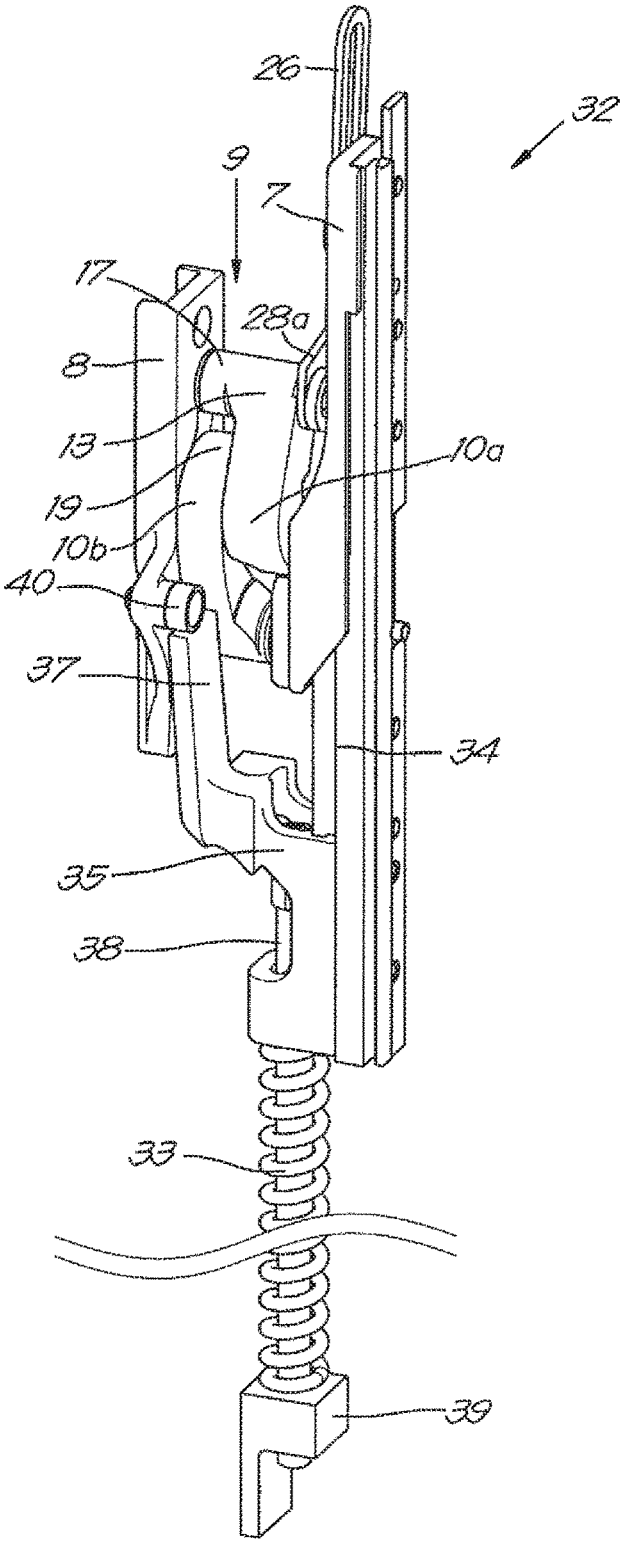
FIG. 11 schematically shows a perspective view of the concealed hinge of FIG. 2 with the spring system mounted thereon.

It is also possible that the guide 34 is affixed to the frame 2 at the location of the frame part 7. This is shown in FIG. 11.

The connecting piece 35 can act on a ridge 40, provided to this end on the leaf part, with the aforementioned tongue 37.

It is clear that, if the spring system 32 with the guide 34 is affixed on the leaf 3, the aforementioned tongue 37 will be able to act on a ridge 40 provided to this end on the frame part.

In this way, under the influence of the spring force the spring system 32 will be able to offset the moment exerted by the weight of the leaf 3.

Figure 12:
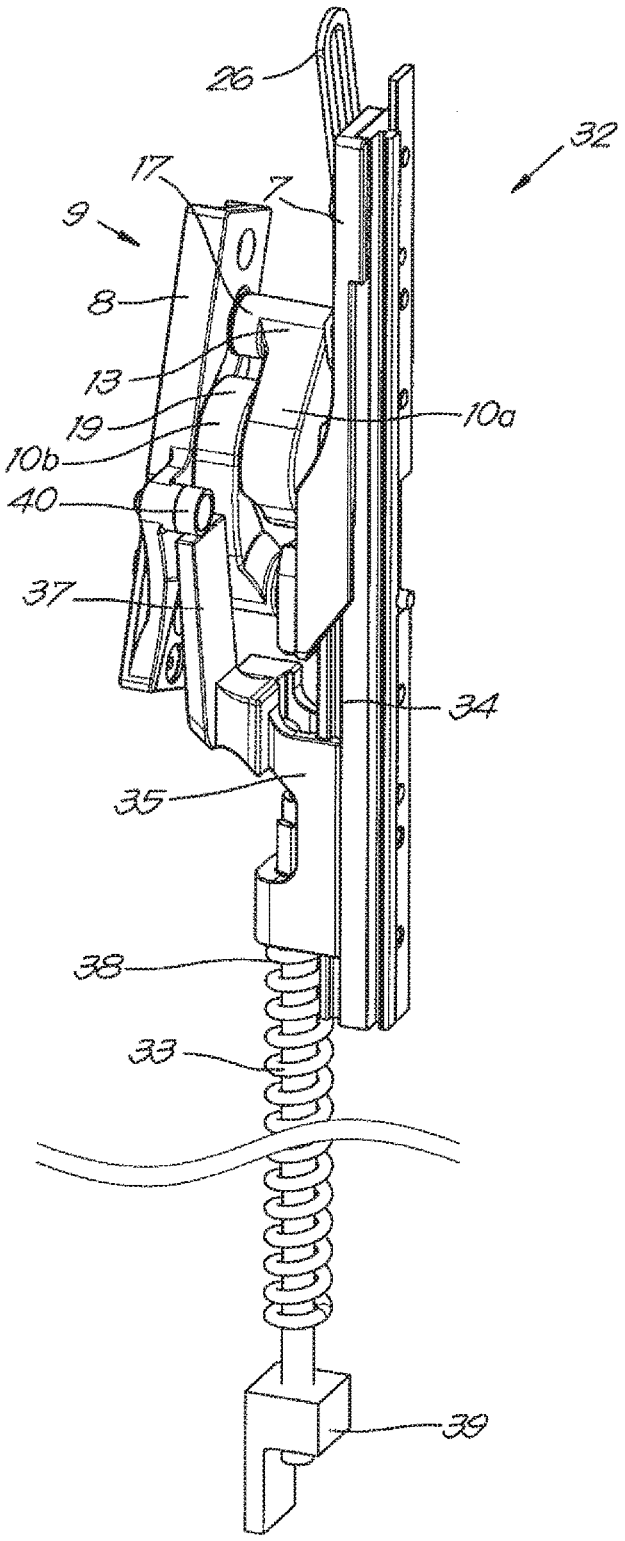
FIG. 12 schematically shows a perspective view of the concealed hinge with the spring system of FIG. 11, but in a different position.

When the leaf 3 starts the first phase of the tilting movement, the connecting piece 35 will be pushed upwards under the influence of the spring force so that the tongue 37 continues to make contact with the aforementioned ridge 40. This is shown in FIG. 12.

In this way the spring mechanism 32 will offset the aforementioned moment during at least part of the first phase of the tilting movement. Indeed, the moment that is exerted on the leaf part 8 by the spring mechanism 32 is opposite to the moment exerted by the weight of the leaf 3.

This has the advantage that the leaf 3 can be easily opened as not a lot of force has to be exerted because the spring mechanism 32 offsets the weight as it were.

By correctly adjusting the spring force, an equilibrium can be created between the moment that the spring system 32 exerts on the leaf part 8 and the opposite moment that the leaf 3 exerts on the leaf part 8. In this way the leaf 3 can remain partially open without the leaf 3 falling shut again.

An additional advantage of the spring system 32 as shown in FIGS. 11 and 12 is that in the closed position of the leaf 3, the spring system 32 will relieve the hinge 6, and in particular the scissor mechanism 9, because the spring system 32 offsets the weight.

As a result this can prevent the leaf 3 falling back in the course of time under the influence of its own weight.

An alternative embodiment of the spring system 32 is presented in FIG. 13. The only difference to the spring system 32 of FIGS. 10 to 12 is that the protruding protrusion 37 acts on the scissor mechanism 9, more specifically on the end 25 of the second arm 10 that is movably held in the slip hole 20 in the frame part 7.

The further operation of this spring system 32 is similar to the spring system 32 previously shown.

Figure 15:
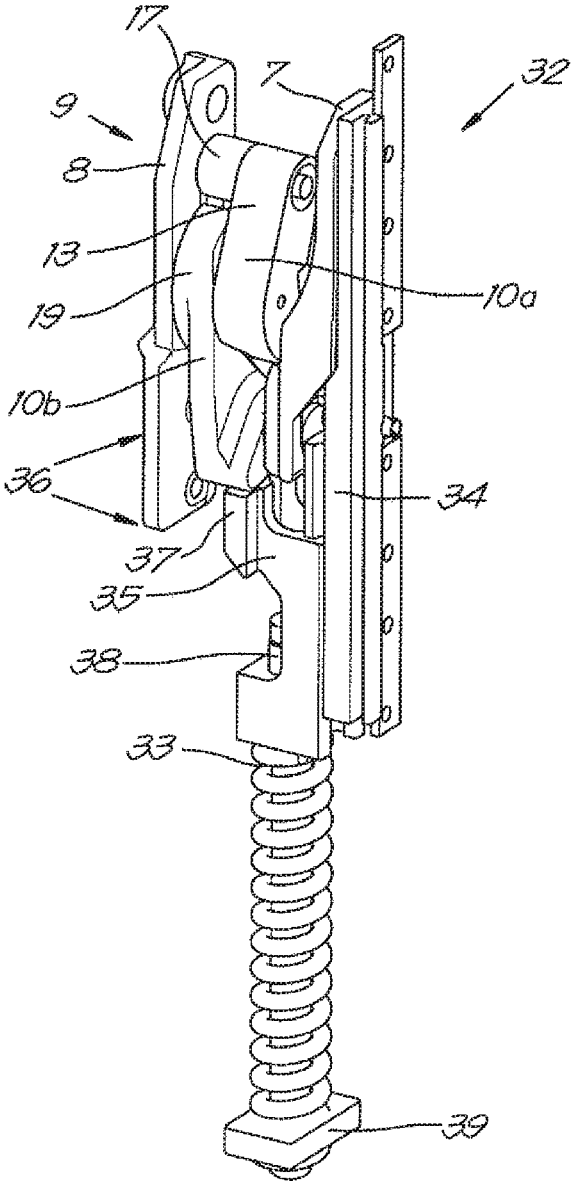
FIGS. 14 to 16 schematically show a perspective view of an alternative embodiment of FIGS. 10 to 12.
Figure 14:
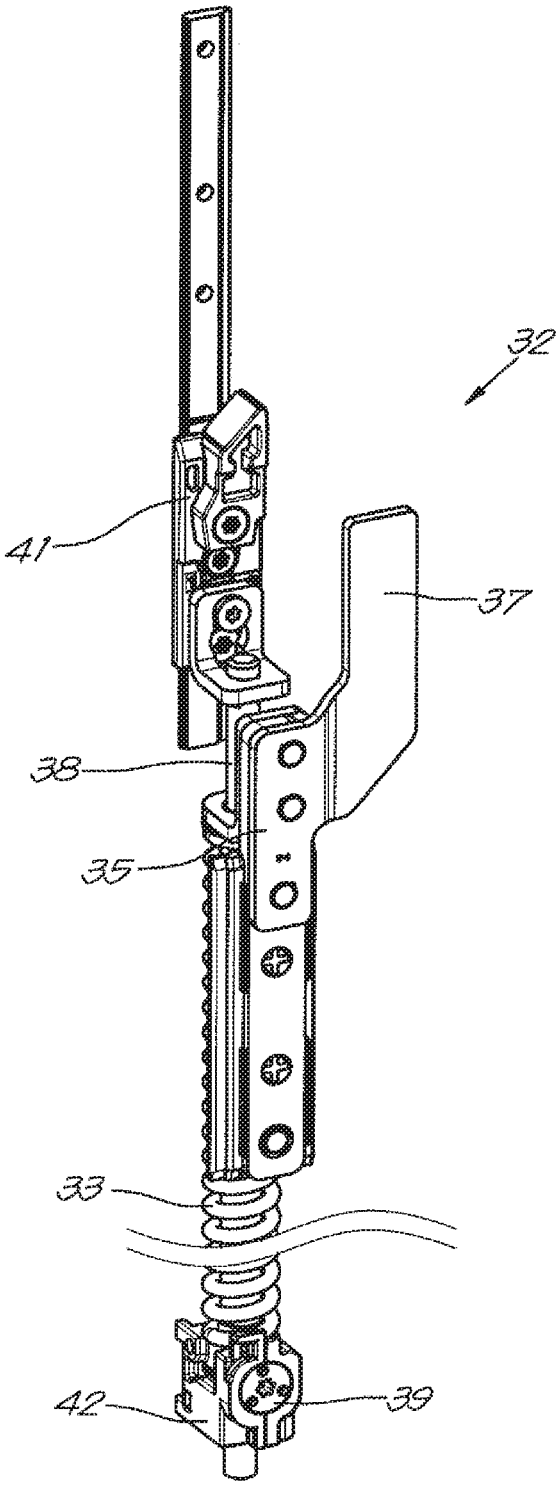
Figure 15:
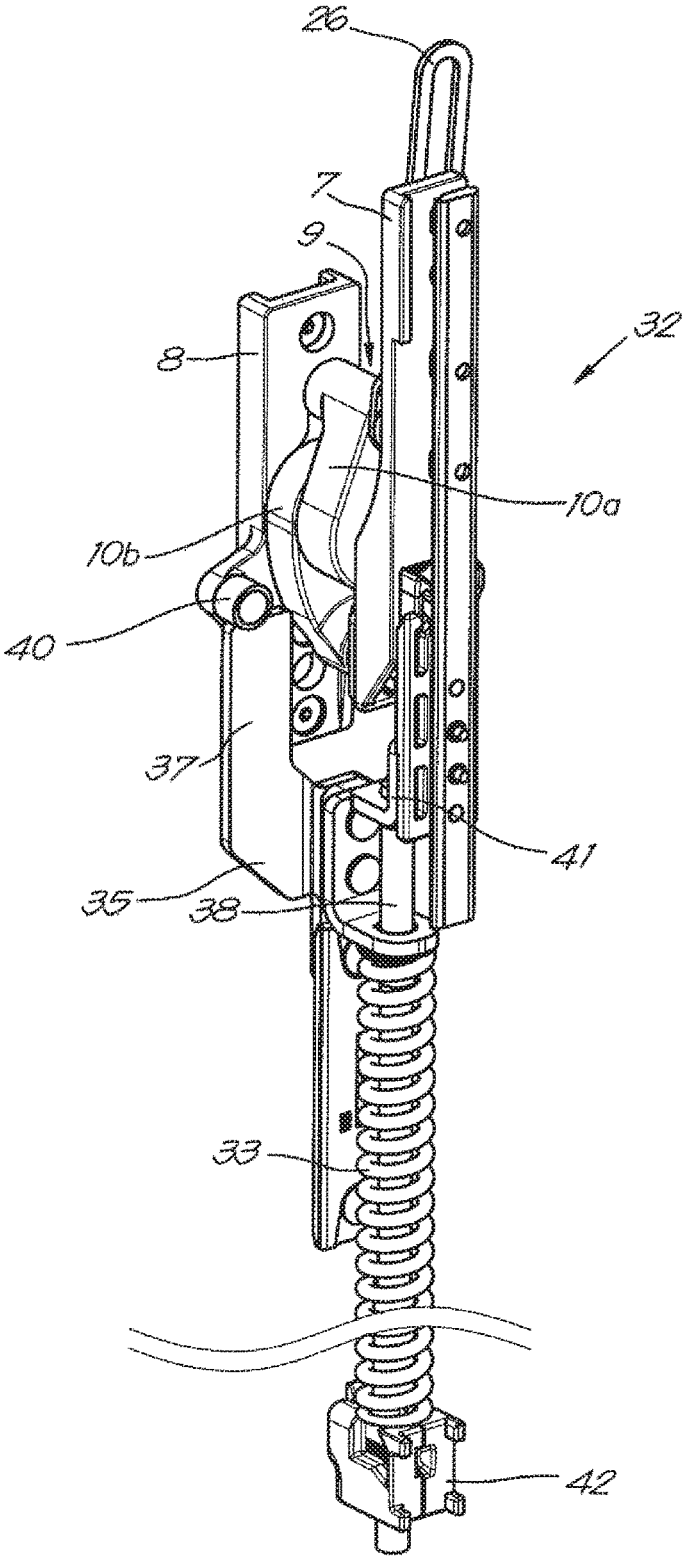
Figure 16:
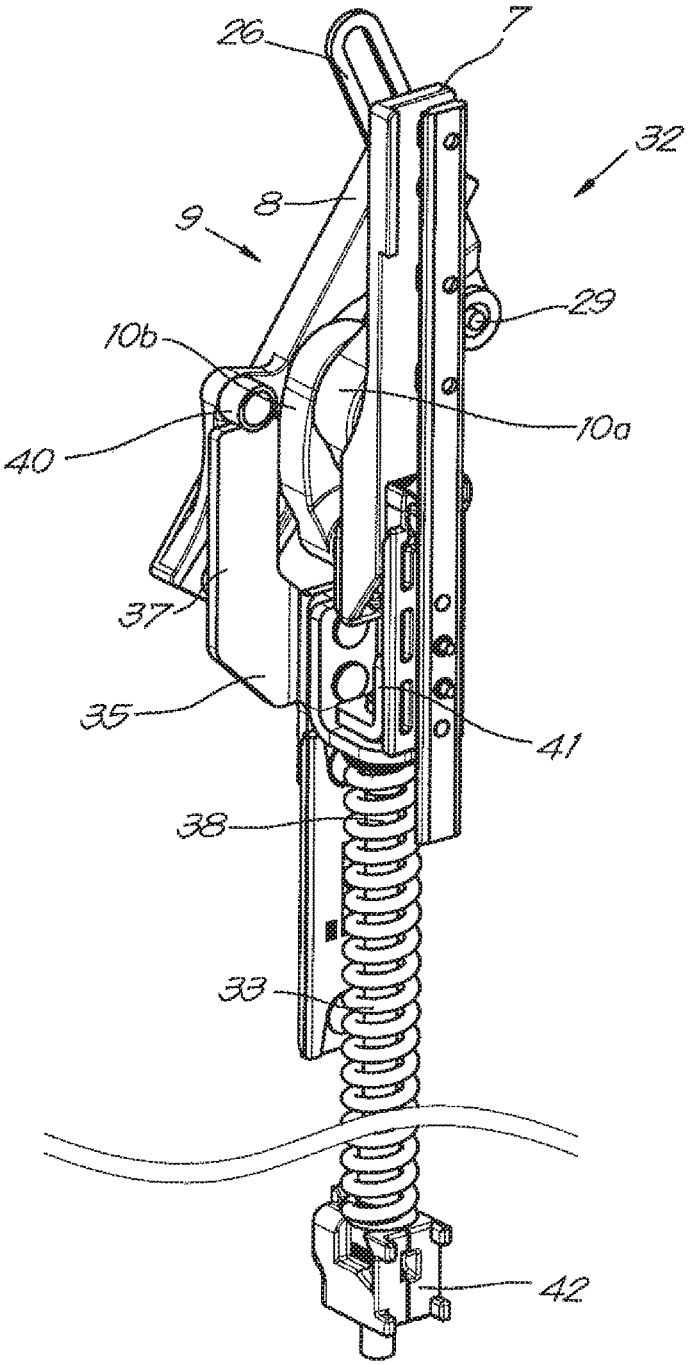

FIGS. 14 to 16 show an alternative embodiment of the spring system 32 of FIGS. 10 to 12.

The spring system 32 differs from the previous embodiment because in this case the guide 34 has been omitted.

Instead of this, the rod 38 is affixed to the frame 2 at the location of the frame part 7 using a suitable coupling 41, as can be seen in FIG. 15.

The connecting piece 35 is movably affixed on the frame 2 at the location of the frame part 7, whereby in this case it is located just below the hinge 6 or the scissor mechanism 9, and is also affixed on the rod 38. The connecting piece 35 is guided by the rod 38 as it were.

The connecting piece 35 is movably affixed on the frame 2 by means of a detail of the profile 4 concerned, such as a tongue-groove connection for example, a chamber or similar.

Alternatively it is possible that the rod 38 is affixed on the leaf 3 at the location of the leaf part 8 and that the connecting piece 35 is movably affixed on the leaf 3 at the location of the leaf part 8. In this case the position of the connecting piece 35 is just above the hinge 6 or the scissor mechanism 9.

Analogous to the previous embodiment, the connecting piece 35 will make contact with the leaf part 8 by means of a ridge 40 provided to this end, such that a moment is exerted on the scissor mechanism 9 that is opposite to the moment exerted by the weight of the leaf 3.

Alternatively the connecting piece 35 can act on the frame part 7 or on the scissor mechanism 9 itself.

Another difference to the spring system 32 of FIGS. 14 to 16 is that the adjustment screw 39 is provided with a perpendicular transmission 42 for turning the adjustment screw 39.

This has the advantage that the adjustment of the adjustment screw is easier because the perpendicular transmission 42 is easier to reach.

The present invention is by no means limited to the embodiments described as an example and shown in the drawings, but a concealed hinge according to the invention for a pivoting window or pivoting door and window equipped therewith can be realised in all kinds of forms and dimensions without departing from the scope of the invention.

The invention claimed is:

1. A hinge for a pivoting window (1) or a pivoting door with a frame (2) and a leaf (3) that can tilt with respect to the frame (2), wherein the hinge (6) comprises:

a frame part (7) configured to be fastened to the frame (2) and a leaf part (8) configured to be fastened to the leaf (3), with a scissor mechanism (9) between the frame part (7) and the leaf part (8) on which the leaf part (8) is hingeably affixed around an axis of rotation (X-X'), whereby the scissor mechanism (9) is such that in a first phase of the tilting movement of the leaf (3) the scissor mechanism (9) comes into operation, so that the axis of rotation (X-X') moves in a direction essentially transverse to a plane of the frame (2) into a locking position whereby the axis of rotation (X-X') is at a distance from the frame (2) such that the axis of rotation (X-X') is a fixed axis around which the leaf (3) can tilt further in a second phase of the tilting movement of the leaf (2), wherein the scissor mechanism (9) comprises two arms (10*a*, 10*b*) that are connected together by a pin and a groove connection (11), whereby the groove (11*a*) has an arched shape and the pin (11*b*) has a corresponding curved form that is movable in the groove (11*a*), whereby one of the two arms (10*a*) has a fixed hinge point (12) on the frame part (7) and has an end (13) that is movably held in a groove (14) of the leaf part (8) whereby an other arm (10*b*) has a fixed hinge point (19) on the leaf part (8) coaxial with the axis of rotation (X-X') and movably held in a slip hole (20) in the frame part (7).

2. The hinge according to claim 1, wherein the scissor mechanism (9) is configured such that movement of the axis of rotation (X-X') during the first phase proceeds horizontally.

3. The hinge according to claim 1, wherein the locking position of the scissor mechanism (9) corresponds to a position of the leaf (3) whereby the leaf (3) includes an angle of between 75 and 115 degrees with the plane of the frame (2).

4. The hinge according to claim 1, wherein the groove (14) of the leaf part (8) comprises a straight piece (14*a*) with a connecting arched piece (14*b*), whereby during the first phase of the tilting movement the end of the arm (10*a*) concerned moves in the straight piece (14*a*) and during the second phase of the tilting movement in the arched piece (14*b*).

5. The hinge according to claim 1, wherein the hinge (6) is provided with a supporting arm (26) that is hingeably connected to the scissor mechanism (9) and via another pin and a groove connection (27) to the frame part (7), whereby the supporting arm (26) will transmit part of a weight to the frame part (7) during the second phase of the tilting movement of the leaf (3).

6. The hinge according to claim 1, wherein the hinge (6) enables the leaf (3) to be tilted over 180 degrees.

7. The hinge according to claim 1, wherein the hinge (6) is provided with a spring system (32) with a spring (33), whereby the spring system (32) offsets the moment exerted by the weight of the leaf (3), at least during a part of the first phase of the tilting movement of the leaf (3).

8. The hinge according to claim 7, wherein the spring (33) is held around a rod (38) or in a tube that is affixed to a guide (34), whereby the guide (34) is affixed either to the leaf (3) at the location of the leaf part (8) or to the frame (2) at the location of the frame part (7), whereby the spring (33) acts on a connecting piece (35) that is movably affixed to the guide (34) and which can make contact with the aforementioned scissor mechanism (9) under the influence of the spring (33), such that a moment is exerted on the scissor mechanism (9) that is opposite to the moment exerted by the weight of the leaf (3).

9. The hinge according to claim 7, wherein the spring (33) is held around a rod (38) or in a tube that is affixed on a guide (34), whereby the guide (34) is affixed either on the leaf (3) at a location of the leaf part (8), or on the frame (2) at a location of the frame part (7), whereby the spring (33) acts on a connecting piece (35) that is movably affixed on the guide (34) and which can make contact with the frame part (7), or the leaf part (8) respectively, under influence of the spring (33) such that a moment is exerted on the frame part (7), or the leaf part (8) respectively, that is opposite to the moment exerted by the weight of the leaf (3).

10. The hinge according to claim 7, wherein the spring (33) is held around a rod (38) or in a tube that is affixed either to the leaf (3) at the location of the leaf part (8) or to the frame (2) at the location of the frame part (7), whereby the spring (33) acts on a connecting piece (35) that is movably affixed on the leaf (3) at the leaf part (8), or on the frame (2) at the location of the frame part (7) respectively, and which is affixed on the rod (38), whereby this connecting piece (35) can make contact with either the frame part (7), or the leaf part (8) respectively, or with the aforementioned scissor mechanism (9) under the influence of the spring (33), such that a moment is exerted on the scissor mechanism (9) that is opposite to the moment exerted by the weight of the leaf (3).

11. The hinge according to claim 7, wherein the spring system (32) comprises an adjustment screw (39) that is affixed to the rod (38), whereby by turning the adjustment screw (39) the force that the spring system (32) or the spring (33) exerts can be changed.

12. The hinge according to claim 11, wherein the adjustment screw (39) is provided with a perpendicular transmission (42) for turning the adjustment screw (39).

13. The hinge according to claim 1, wherein in a closed position of the leaf (3) the scissor mechanism (9) is entirely between the frame part (7) and the leaf part (8).

14. The hinge according to claim 1, wherein the frame part (7) and the leaf part (8) are affixed on the frame (2), or the leaf (3) respectively, such that the hinge (6) cannot be seen when the leaf (3) is in the closed position.

15. A window with a frame (2) and a leaf (3) that can tilt with respect to the frame (2), wherein the window (1) is provided with at least two hinges (6) according to claim 1, such that both hinges (6) form a horizontal or vertical axis of rotation (X-X') around which the leaf (3) can tilt horizontally or vertically.

* * * * *